US007534134B2

(12) United States Patent
Qiu

(10) Patent No.: US 7,534,134 B2
(45) Date of Patent: May 19, 2009

(54) ELECTRICAL CONNECTOR RETAINING MECHANISM HAVING SLIDE CLIP MEMBER

(75) Inventor: Shi-Qing Qiu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/716,766

(22) Filed: Mar. 12, 2007

(65) Prior Publication Data

US 2008/0227331 A1 Sep. 18, 2008

(30) Foreign Application Priority Data

Mar. 11, 2006 (CN) ..... 2006 2 0070290

(51) Int. Cl.
*H01R 13/60* (2006.01)

(52) U.S. Cl. ..... 439/527; 439/733.1

(58) Field of Classification Search ..... 439/527, 439/542, 444, 733.1
See application file for complete search history.

(56) References Cited

U.S. PATENT DOCUMENTS 3,422,395 A * 1/1969 Fisher ..... 439/889
3,577,116 A * 5/1971 Baumanis ..... 439/542
4,118,596 A * 10/1978 Bassett et al. ..... 174/87
4,443,048 A * 4/1984 Moist, Jr. ..... 439/599
4,544,220 A * 10/1985 Aiello et al. ..... 439/594
4,573,754 A * 3/1986 Hill ..... 439/280
5,591,054 A * 1/1997 Okada et al. ..... 439/884
5,636,937 A * 6/1997 Zemlicka ..... 403/388
5,775,963 A * 7/1998 Byfield, Jr. ..... 439/884
5,915,978 A * 6/1999 Hayakawa et al. ..... 439/76.2
6,000,949 A * 12/1999 Takiguchi et al. ..... 439/34
6,203,364 B1 3/2001 Chupak
6,331,742 B1 * 12/2001 Renkes et al. ..... 310/68 C
6,341,755 B1 * 1/2002 Kump ..... 248/220.41
6,413,118 B2 * 7/2002 Fukatsu ..... 439/542
6,700,197 B2 * 3/2004 Sato et al. ..... 257/727
6,994,504 B2 * 2/2006 Gordon ..... 411/508
6,994,558 B2 * 2/2006 Cortinovis ..... 439/34
7,347,742 B2 * 3/2008 Hall et al. ..... 439/752
2006/0264095 A1 * 11/2006 Gabalski et al. ..... 439/542
2007/0257587 A1 * 11/2007 Jackson ..... 312/330.1

* cited by examiner

*Primary Examiner*—T C Patel
*Assistant Examiner*—Vladimir Imas
(74) *Attorney, Agent, or Firm*—Wei Te Chung

(57) ABSTRACT

A slide clip member (2) includes a generally flat base (21), attachment features (23) integrally molded with the base for locking the slide clip member to adjacent support structure, and a locking arm (22) longitudinally projecting from the base. The slide clip member includes at least three protrusions (24) alternately arranged at two lateral sides of the base for horizontally attaching the slide clip member to an exterior channel (15) in an interference fit manner.

14 Claims, 4 Drawing Sheets

ELECTRICAL CONNECTOR RETAINING MECHANISM HAVING SLIDE CLIP MEMBER

BACKGROUND OF THE INVENTION

1. Field of the Invention

The present invention relates generally to an electrical connector retaining mechanism, and particularly to such electrical connector retaining mechanism employing a slide clip-type mounting system for securing the retaining mechanism to adjacent support structure.

2. Description of Related Arts

Electrical connectors of the general type include matable male and female connector members each with electrical terminals that are coupled when the connector members are jointed to establish an electrical connection therebetween. The male connector member plugs into a socket of the female connector member and locks with the female connector member in a full assembly condition by matable locking features respectively formed on the connector members.

When the male connector member is used in a vehicle or the like, a separate slide clip piece is provided and releasably received in a channel of the male connector member for mounting the male connector member on adjacent support structure, such as on a body panel, support bracket, etc. of the vehicle or the like. Suitable attachment features, such as a push-in Christmas tree-type fastener, are molded integrally with the slide clip piece for mounting the connector on the support structure. However, when the slide clip piece is pushed into the channel of the male connector member, some problems are provided simultaneously. First, because of a dimensional deviation from a normal value in a manufacturing process to produce the slide clip piece, there may form a gap between the slide clip piece and the channel of the male connector member after a full assembly, thereby causing the connection therebetween unsteady. Second, because conventional slide clip piece does not provide a leading structure for guiding an insertion of the slide clip piece to the channel of the male connector member, it is difficult to assemble them together conveniently.

For example, U.S. Pat. No. 6,203,364B1 which issued to Delphi on Mar. 20, 2001 shows a conventional electrical connector assembly including a male connector and a separate slide clip component that is received in a channel of the male connector. The slide clip and channel include matable detent and bump lock projection features engagable with each other when the slide clip is fully installed in the channel to lock the slide clip against removal from the male connector. However, it seems complicated to assemble them together duo to their complicated structure.

Hence, an electrical connector retaining mechanism having improved slide clip member is desired.

SUMMARY OF THE INVENTION

Accordingly, the object of the present invention is to provide an electrical connector having improved slide clip member for attaching the connector to a matable connector reliably.

Accordingly, another object of the present invention is to provide an electrical connector retaining mechanism having improved slide clip member for attaching them reliably.

The third object of the present invention is to provide an improved slide clip member for engaging with a complementary component more reliably and conveniently.

To achieve the above objects, a retaining mechanism in according with the present invention comprises a connector housing, and a slide clip member releasably assembled to the connector housing. The slide clip member further comprises a flat base with a pair of lateral sides respectively received in a pair of channels provided on the connector housing. The slide clip member further comprises a plurality of protrusions alternately formed on two lateral sides of the base for attaching the slide clip member to the channels reliably in an interference fit manner.

A slide clip member in according with the present invention comprises a generally flat base, an attachment features integrally molded with the base for locking the slide clip member to adjacent support structure, and a locking arm longitudinally projecting from the base. In contrast to prior art, the slide clip member of present invention comprises at least three protrusions alternately arranged at two lateral sides of the base for horizontally attaching the slide clip member to an exterior channel in an interference fit manner.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
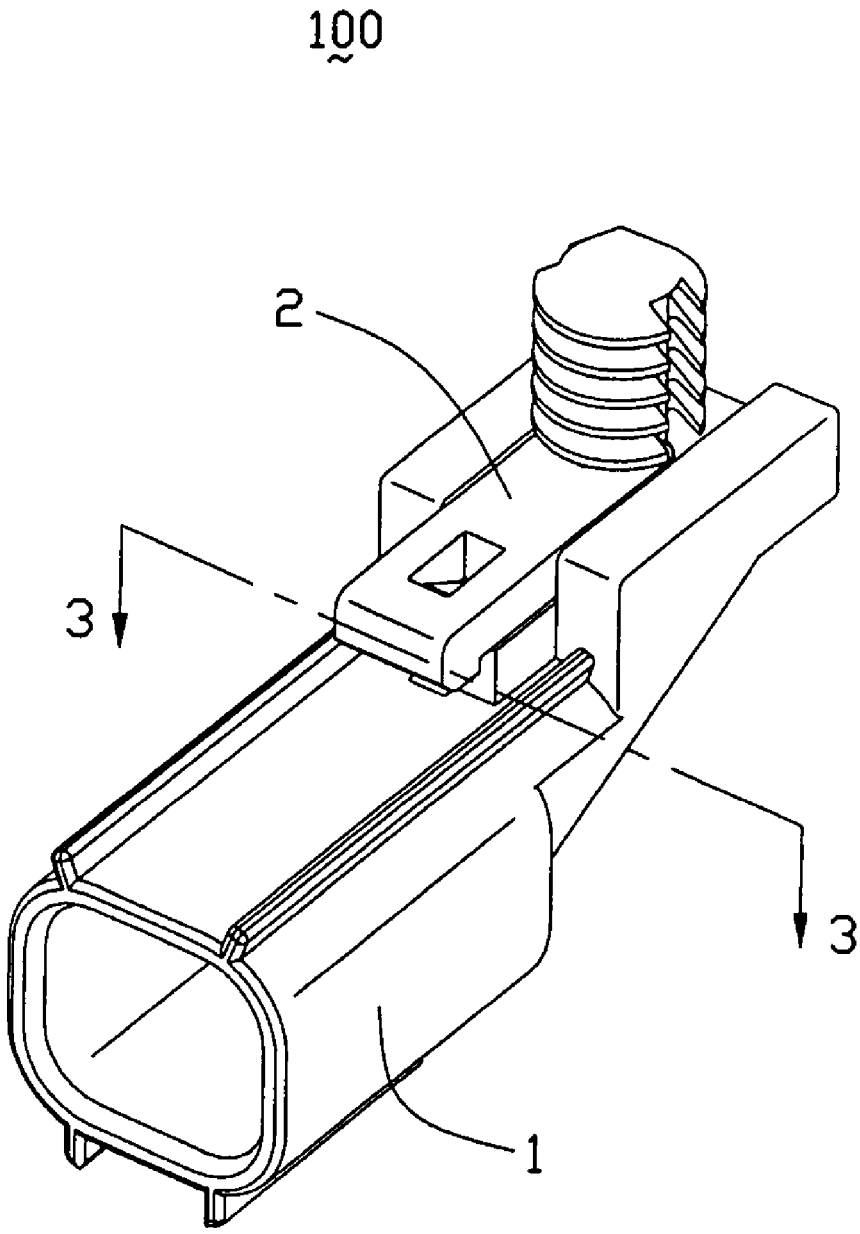
FIG. 1 is a perspective, assembled view of an electrical connector retaining mechanism in accordance with the present invention.

An electrical connector retaining mechanism constructed according to a presently preferred embodiment of the invention is indicated generally at 100 in the drawings and comprises a connector housing 1 and a slide clip member 2 slidably assembled to the connector housing 1.

The connector housing 1 are preferably molded as one piece, and comprises a tubbish receiving space 11 and a connecting portion 12 extending longitudinally from the receiving space 11 and constructed in a stepped manner relative to the receiving space 11. In this preferred embodiment, the receiving space 11 is used for receiving a male connector (not shown) which is capable of mating with a female connector (not shown) for establishing an electrical connection therebetween. The connecting portion 12 comprises a flat main portion 16 and a pair of laterally spaced walls 160 having upstanding side wall portions 161 that project from the main portion 16 and a pair of upper wall portions 162 extending laterally inwardly from corresponding side wall portions 161 toward each other and disposed in space relation to the main portion 16. Associated with the main portion 16, the pair of laterally spaced walls 160 defines a pair of receiving channels 15 that is accessible to the slide clip member 2 with the slide clip member 2 being fully assembled to the connector housing 1 and a middle slot 14 formed between the pair of receiving channels 15. The main portion 16 further comprises a nose 17 longitudinally projecting a determined distance relative to one rear surface of the laterally spaced walls 160 with a locking projection 13 being formed thereon and directed toward the middle slot 14.

In the preferred embodiment, the slide clip member 2 is a molded plastic member, but also can adopt the other material, such as metal or the like, to produce without departing from the spirit of the present invention. The slide clip member 2 has a generally flat, longitudinally extending base 21, a locking arm 22 longitudinally projecting from the base 21 and with a part being overlapped with the base 21, and attachment feature 23 formed on the base 21 and that are operative for mounting the electrical connector retaining mechanism 100 to adjacent support structures, such as the body of vehicle or the like. The attachment feature 23 is preferably molded as one piece with the slide clip member 2 and is configured to accommodate the particular mounting requirements for each application. As an example, the illustrated embodiment shows the attachment feature 23 as comprising a push-in Christmas tree-type fitting (not labeled) uprightly extending from the base 21. Certainly, other structures, such as screw, locking claw, can be employed to instead of Christmas tree-type fitting without departing from the spirit of the present invention. The locking arm 22 that is capable of sliding along the middle slot 14 when the slide clip member 2 and connector housing 1 is in an assembly state and comprises a locking opening 25 adjacent to a free end thereof for locking with the locking projection 13 of the connector housing 1, and a locking bar 26 adjacent to the locking opening 25 for locking a rear surface of the nose 17. Further, the base 21 comprises a plurality of protrusions 24 alternately formed on two lateral sides thereof. In the preferred illustrated embodiment, three protrusions, the first protrusion 241, the second protrusion 242 and the third protrusion 243, are preferably provided for the public catching on the spirit of present invention. The first and second protrusions 241, 242 are formed on one lateral side of the base 21 and spaced from each other in a lateral view, the third protrusion 243 is formed on the other lateral side of the base 21. These three protrusions 241, 242, 243 are alternately arranged in a lateral view, and the third protrusion 243 is disposed at the middle of the first and second protrusions 241, 242 in the lateral view. In a preferred embodiment, there will form an isosceles triangle by lining every two protrusions. Noticeably, the distance "B" between two receiving channels 15 is slightly less than the distance "M" between the ends of the first and second protrusions 241, 242, but slightly larger than the distance "L" between the two lateral sides of the base 21, thereby causing the slide clip member 2 to mate with the channels 15 in aN interference fit manner. In addition, the base 21 further comprises a fourth protrusion 27 formed on a lower surface thereof.

Figure 2:
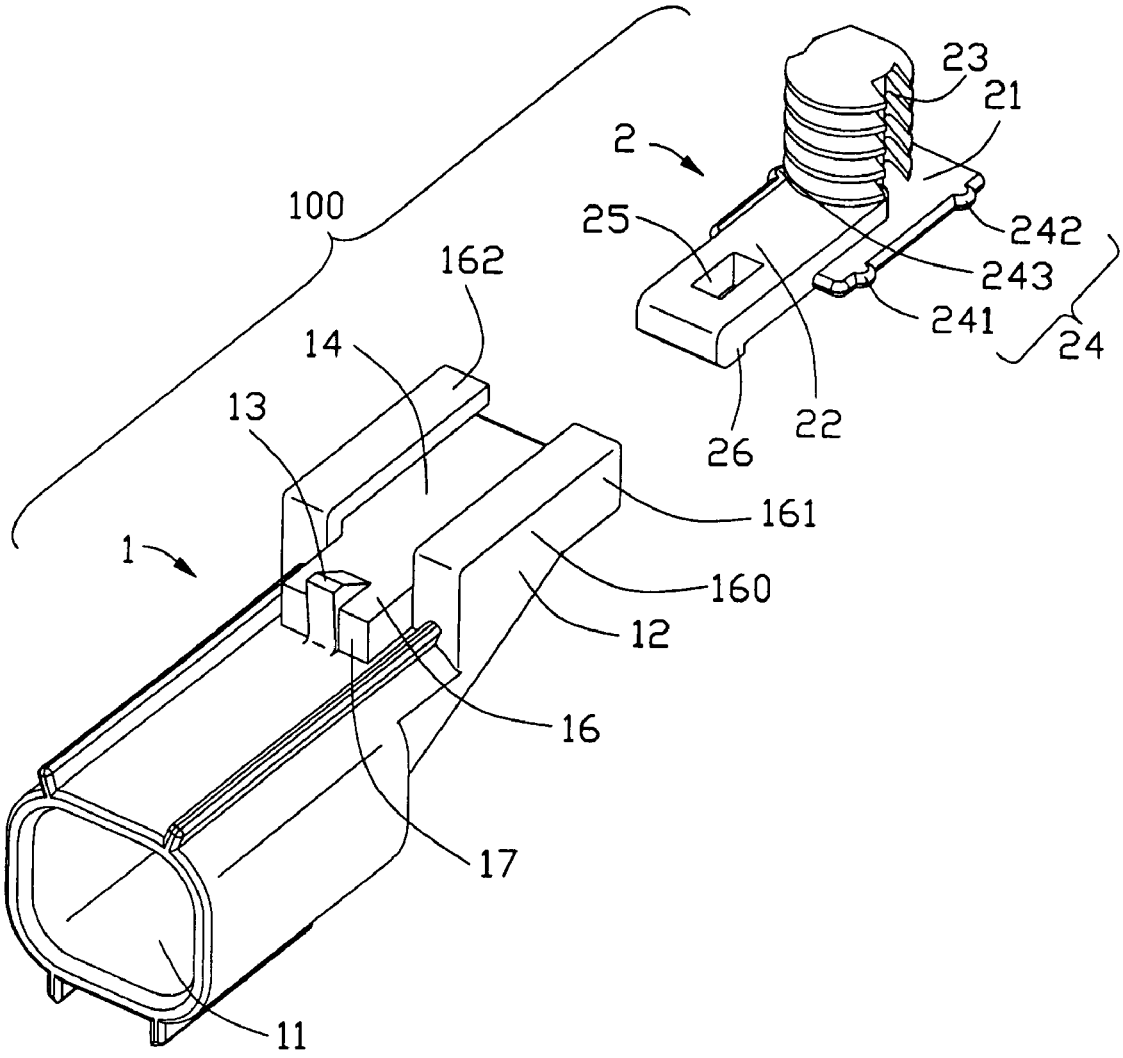
FIG. 2 is a perspective, exploded view of the electrical connector retaining mechanism of FIG. 1.
Figure 3:
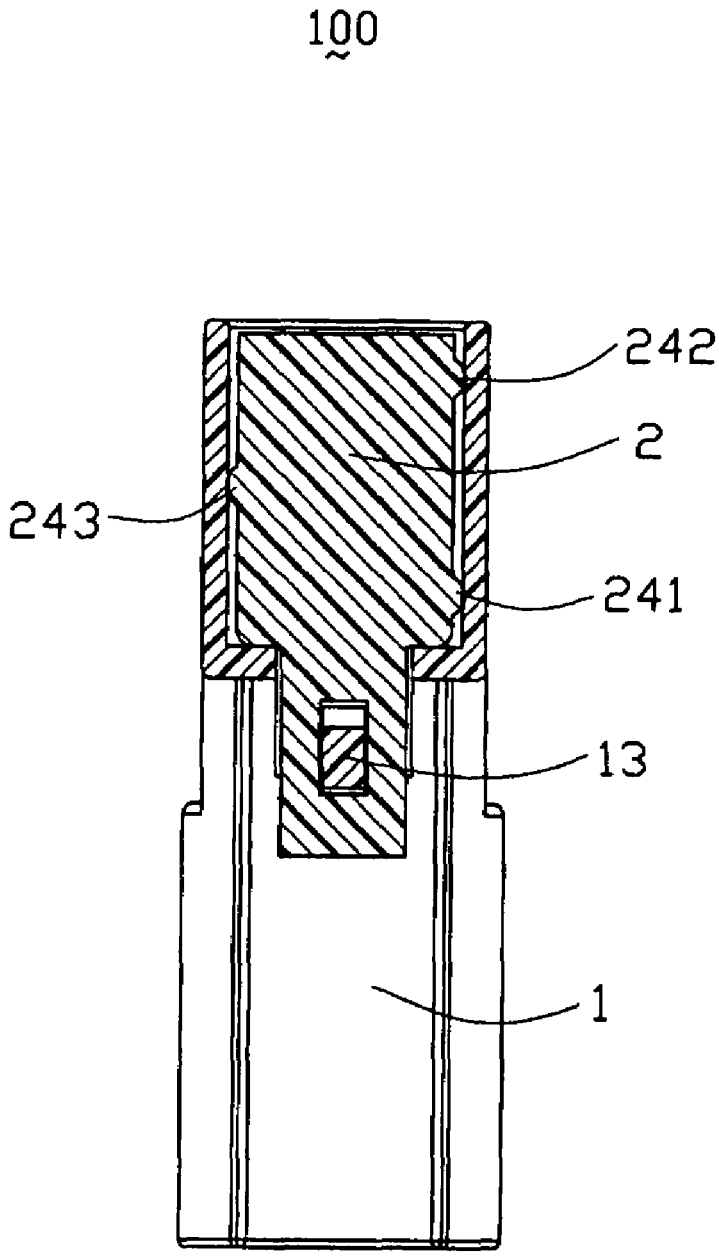
FIG. 3 is a cross sectional view of the electrical connector retaining mechanism taken along line 3-3 of FIG. 1.
Figure 4:
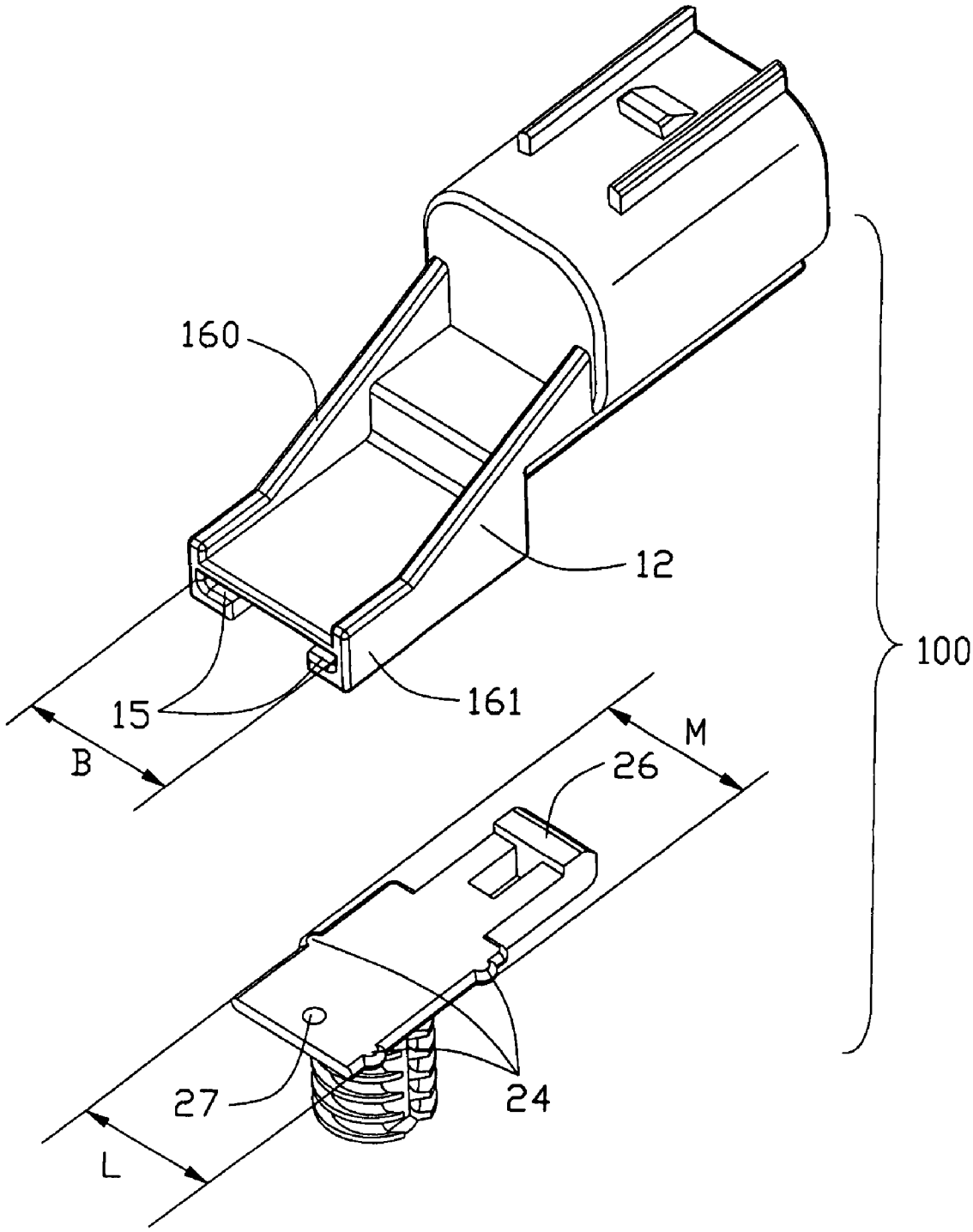
FIG. 4 is a view similar to FIG. 2, but taken from a different aspect.

Referring to FIGS. 1-4, in assembly, the slide clip member 2 is assembled with the connector housing 1 by extending the slide clip member 2 into the open end of the channels 15, with the locking arm 22 sliding through the middle slot 14. After a sliding distance of the locking arm 22, the flat base 21 is pushed into the receiving channels 15. Detailedly, during an insertion of the base 21 into the receiving channels 15, the first protrusion 241 is first pushed into one channel 15, the distance between the free end of the first protrusion 241 and one lateral side of the base 21 is less than the distance between inner lateral surfaces of channels 15, thus enabling the slide clip member 2 to slide forwardly freely in the longitudinal direction. Later, when the third protrusion 243 is pushed and touches with the inner lateral surface of the other receiving channel 15, it is slightly difficult to push the base 21 into the channel 15 because of interference. Here, a person can shake the slide clip member 2 right-and-left and push the third protrusion 243 into the receiving channel 15 by exerting force on the slide clip member 2. Later, the second protrusion 242 is pushed and touches with the one receiving channel 15, despite that the interference fit between the base 21 and the channels 15 make an insertion of the second protrusion 242 into the receiving channel 15 difficultly, the second protrusion 242 can be inserted into the channel 15 by a guide of main part of the base 21 that are received in the channels 15 and an exterior force exerted on the base 21. Almost simultaneously, the fourth protrusion 27 is pushed into and abuts against the bottom surface of middle slot 14 in an interference fit manner. Further, while the base 21 is fully assembled to the channels 15 and the middle slot 14, the locking bar 26 locks with a rear surface of nose 17, the locking projection 13 is received in the locking opening 25 for together preventing a rearward movement of the slide clip member 2.

In another embodiment of present invention, other structures alternately formed two lateral sides of the base 21, such as some inclining portions (not shown), can replace the protrusions 241, 242, 243 used in above embodiment and achieving same function. In another embodiment of present invention, the slide clip member 2 can be mated with an electrical connector chiefly same as the male connector shown in U.S. Pat. No. 6,203,364B1 and with a connecting portion 12 being formed thereon. In another embodiment of present invention, instead of providing the protrusions on lateral sides of slide clip member 2, one can provide the protrusions on inner surfaces of the channels 15, such as lateral inner surfaces or upper inner surface, to reliably fix the slide clip member 2 with the connector housing 1.

The protrusions 24 of the slide clip member 2 not only can avoid clearance between the slide clip member 2 and the channels 15, but also can make an assembly between the slide clip member 2 and a complementary component, such as the electrical connector retaining mechanism 100, an electrical connector with the connecting portion 12 conveniently and reliably. In addition, the first, second and third protrusions 241, 242, 243 can fix the slide clip member 2 against removal horizontally from the channels 15 of the connector housing 1, the fourth protrusion 27 can fix the slide clip member 2 against looseness vertically from the connector housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector retaining mechanism, comprising:

a connector housing having a pair of channels respectively provided on two sides thereof;

a slide clip member disposed in said channels;

at least three protrusions arranged on at least one of inner surfaces of said channels and lateral sides of said slide clip member, comprising first and second protrusions disposed at one inner surface or one lateral side and spaced each other, and a third protrusion disposed at the other inner surface or the other lateral side and between the first and second protrusions in a longitudinal view, whereby the slide clip member mates with channels more reliably in an interference fit manner.

2. The electrical connector retaining mechanism as described in claim 1, further comprising a fourth protrusion provided on a lower surface of the slide clip member for preventing the slide clip member from removal in the vertical direction when the slide clip member is fully assembled to the connector housing.

3. The electrical connector retaining mechanism as described in claim 1, wherein the slide clip member further comprises attachment feature for mounting the electrical connector retaining mechanism on adjacent support structure.

4. The electrical connector retaining mechanism as described in claim 1, wherein the slide clip member further comprises a generally flat base with two lateral sides being received in the channels, and a locking arm longitudinally extending from the base for locking the slide clip member with a complementary component of the connector housing.

5. A slide clip member comprising:

a generally flat base having a pair of lateral sides opposite to each other;

attachment feature formed unitarily and vertically positioned to the base, the attachment feature being capable of mounting the slide clip member on adjacent support structure; and a cantilevered locking arm projected longitudinally away from the base, the locking arm having a locking projection disposed at a free end thereof;

wherein at least three securing structures are provided on lateral sides of the base, which comprise first and second securing structures disposed at one lateral side and spaced each other, and a third securing structure disposed at the other lateral side and between the first and second protrusions in a longitudinal view, for attaching the slide clip member to an exterior channel in an interference fit manner.

6. The slide clip member as described in claim 5, wherein the at least three securing structures comprise protrusions alternately arranged on two lateral sides.

7. The slide clip member as described in claim 5, wherein the at least three securing structures comprise inclining portions alternately arranged on two lateral sides.

8. The slide clip member as described in claim 5, wherein the distance between the first securing structure and the third securing structure is equal to the distance between the second securing structure and the third securing structure.

9. The slide clip member as described in claim 5, further comprising a protrusion disposed on a lower surface of the base for vertically attaching the slide clip member to a slot of a complementary component in an interference fit manner.

10. An electrical connector assembly comprising:

a connector comprising a longitudinal connector housing having a connecting portion, said connecting portion comprising a generally flat main portion and a pair of laterally spaced walls having upstanding side wall portions that projecting from the main portion and upper wall portions that extending laterally inwardly from the side wall portions in space relation to the main portion, the main portion and the laterally spaced walls together defining a pair of receiving channels;

a slide clip member slideably assembled to the connector, and comprising a generally flat base, an attachment feature integrally molded with the base, and a locking arm longitudinally projecting from the base for locking the slide clip member to the connector housing;

wherein the slide clip member comprises at least three protrusions alternately disposed on two lateral sides of the base, with first and second protrusions disposed at one lateral side and spaced each other, and a third protrusion disposed at the other lateral side and between the first and second protrusions in a longitudinal view, for attaching the slide clip member to the channels in an interference fit manner.

11. The electrical connector assembly as described in claim 10, further comprising a protrusion disposed on a lower surface of the base for vertically attaching the slide clip member to a slot of the connector housing in an interference fit manner.

12. The electrical connector retaining mechanism as described in claim 1, wherein the protrusions extend in a first direction which is perpendicular to a second direction along which the lateral sides of the slide clip member extend.

13. The electrical connector retaining mechanism as described in claim 4, wherein the complementary component comprises a nose arranged on the connector housing, and the locking arm comprises a locking bar locking with a rear surface of the nose.

14. The electrical connector retaining mechanism as described in claim 13, wherein the complementary component further comprises a locking projection arranged on the nose, which is received in a locking opening defined in the locking arm of the slide clip member.

* * * * *